United States Patent [19]

Johnston

[11] 4,329,962

[45] May 18, 1982

[54] DIESEL INJECTION PUMP TIMING CONTROL WITH ECCENTRIC CAM PIN

[75] Inventor: Laird E. Johnston, Birmingham, Mich.

[73] Assignee: General Motors Corporation, Detroit, Mich.

[21] Appl. No.: 192,109

[22] Filed: Sep. 29, 1980

[51] Int. Cl.[3] ..... F02M 59/20

[52] U.S. Cl. ..... 123/502; 123/501

[58] Field of Search ..... 123/501, 502; 417/462

[56] References Cited

U.S. PATENT DOCUMENTS 3,771,506 11/1973 Davis ..... 123/502
3,861,833 1/1975 Salzgeber et al. ..... 417/254
4,177,775 12/1979 Hofer et al. ..... 123/502
4,262,645 4/1981 Kobayashi et al. ..... 123/502

*Primary Examiner*—Ira S. Lazarus
*Assistant Examiner*—Magdalen Moy
*Attorney, Agent, or Firm*—Arthur N. Krein

[57] ABSTRACT

An engine driven fuel injection pump of the type having a cam ring and an advance timing control mechanism to adjust the angular position of the cam ring has an eccentric cam pin effecting an operative interconnection between the cam ring and the advance piston of the timing control mechanism. An externally accessible adjusting means is used to rotate the eccentric cam pin so as to shift the position of the cam ring relative to the advance piston, as necessary, to effect correct static timing of the pump to the engine.

3 Claims, 3 Drawing Figures

DIESEL INJECTION PUMP TIMING CONTROL WITH ECCENTRIC CAM PIN

FIELD OF THE INVENTION

This invention relates to engine driven diesel fuel injection pumps and, in particular, to a control means for such a pump having an eccentric cam pin incorporated therein that is externally adjustable whereby to accurately effect static timing of the pump.

DESCRIPTION OF THE PRIOR ART

A conventional fuel injection pump, of the type disclosed, for example, in U.S. Pat. No. 3,861,833 entitled "Fuel Injection Pump" issued Jan. 21, 1975 to Daniel Salzgeber, Robert Raufeisen and Charles W. Davis, is adapted to deliver metered charges of fuel under high pressure sequentially to the cylinders of an associated engine in timed relationship therewith. In a pump of the above-identified type, a cam ring having inwardly directed cam lobes surrounds one or more pump plungers that are movable relative thereto whereby to translate the contour of the cam lobes into a sequence of pumping strokes producing the high pressure charges of fuel to be delivered to the engine.

Normally, a timing advance mechanism is used to adjust the angular position of the cam ring whereby to regulate the timing of injection into the cylinders of the engine as a function of engine speed. Such a timing advance mechanism may be hydraulically actuated as shown, for example, in U.S. Pat. No. 3,771,506 entitled "Fuel Injection Pump and Automatic Timing Means Therefor" issued Nov. 13, 1973 to Charles W. Davis or in the above-identified U.S. Pat. No. 3,861,833, it may be electro-hydraulically actuated as shown, for example, in U.S. Pat. No. 4,033,310 entitled "Fuel Pumping Apparatus with Timing Correction Means" issued July 5, 1977 to Wilfrid E. W. Nicolls, or as shown in Applicant's copending application Ser. No. 192,108, entitled "Diesel Injection Pump Timing Control with Electronic Adjustment" filed concurrently herewith, and assigned to a common assignee.

Such an engine driven pump is operated at camshaft speed when applied to a four-stroke cycle engine. Accordingly, for such a pump to operate satisfactorily to supply fuel to the engine during the various modes of engine operation, it must be initially statically times with the engine.

For this purpose, the pump housing is normally provided with a mounting flange having circumferentially spaced apart arcuate shaped or so-called kidney-shaped mounting slots to receive the mounting bolts that are then threadingly engaged in a suitable support flange provided for this purpose on the engine.

Alternately, as is well known, especially where pump housing rotation is not practical, corresponding static timing can be obtained by means of a hub used on the pump drive shaft and by means of circumferentially spaced apart kidney-shaped slots provided in the drive gear to receive the mounting bolts used to secure the hub and gear together.

With for example, the above described flange mounting arrangement, static timing of the pump to engine is done by rotating the pump housing so that suitable timing marks, provided for this purpose, can be aligned. After this form of static timing has thus been established, the mounting bolts are then secured. Thereafter the engine and pump are turned over to verify the timing with respect to a particular cylinder of the engine, for example, the number one cylinder when at its top dead center portion. If at that time it is found that the correct timing has not in fact been correctly established, the mounting bolts must be loosened to again permit rotative displacement of the pump housing in either direction, as necessary whereby to correctly adjust the pump relative to the engine for the required static timing of the pump to the engine.

SUMMARY OF THE INVENTION

The present invention relates to an injection pump timing control mechanism wherein the cam pin interconnecting the advance piston of the timing mechanism to the cam ring of the pump is in the form of an eccentric cam pin having a head engaging the cam ring that is offset eccentric of the axis of the main body of the pin, carried by the advance piston, and a foot offset eccentric to the axis of the main body but offset, for example, 90° from the head. In addition, an externally accessible adjusting means is supported in the pump housing in position to engage the foot whereby to effect rotative positioning of the eccentric cam pin whereby to cause movement of the cam ring, as desired, so as to obtain the required static timing of the pump to the associated engine.

It is therefore a primary object of this invention to provide an improved timing advance mechanism for an engine driven diesel fuel injection pump whereby an externally accessible adjusting means is used to adjust the angular position of an eccentric cam pin whereby to adjust static timing of the pump to the engine.

Another object of this invention is to provide an improved timing advance mechanism for an engine driven fuel injection pump wherein the mechanism includes an eccentric cam pin interconnecting an advance piston to the cam ring of the pump and, an externally accessible adjusting means is operatively positioned to engage one end of the eccentric cam pin whereby to effect more readily the static timing of the pump to the associated engine.

Still another object of the present invention is to provide a timing advance mechanism with eccentric cam pin of the above type which includes features of construction, operation and arrangement, rendering it easy and inexpensive to manufacture, which is reliable in operation, and in other respects is suitable for use on production motor vehicle fuel injection pump systems.

For a better understanding of the invention as well as other objects and further features thereof, reference is had to the following detailed description of the invention to be read in connection with the accompanying drawing.

DESCRIPTION OF THE PREFERRED EMBODIMENT

Figure 1:
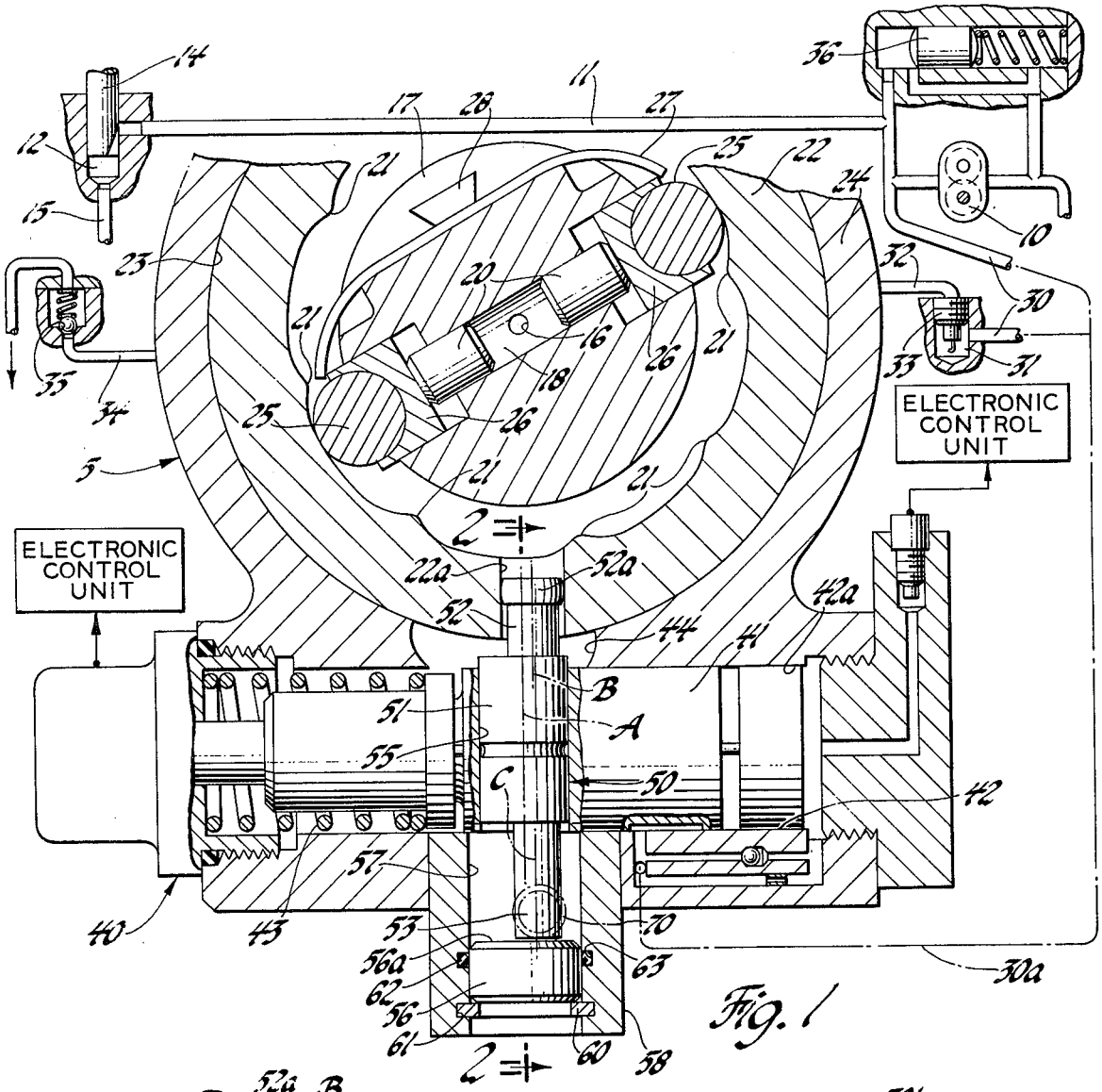
FIG. 1 is an end elevation view, partially in section and partly schematic, of a fuel injection pump having incorporated therein a timing control mechanism with eccentric cam pin in accordance with the invention; the eccentric cam pin only being shown in a full retard position for purpose of illustration while the timing mechanism, other than the eccentric cam pin, and the cam ring of the pump being shown in a position midway between full retard and full advance also for purposes of illustration only, the location of the adjusting screw associated with the eccentric cam pin being shown in phantom lines.

As shown in FIG. 1, the subject timing control mechanism with eccentric cam pin is incorporated into an engine driven fuel injection pump 5 of a type similar to that shown in the above-identified U.S. Pat. No. 3,861,833 that is operative to pressurize fuel sequentially to a plurality of injectors associated with the cylinders of an engine, both not shown. In this type pump, fuel at a predetermined pressure, as a function of engine speed, is delivered from the outlet of an engine driven transfer pump 10 via a passage 11 to a metering valve chamber 12. A metering valve 14, operatively positioned in the metering valve chamber 12, provides a variable restriction whereby to control the flow of fuel delivered by a passage 15 which is suitably connected, in a known manner, to an axial passage 16 in the distributor rotor 17 driven in a counter-clockwise direction with reference to FIG. 1, whereby to supply fuel to the pump chamber 18 of the high pressure injection pump portion of the pump unit.

As shown, the high pressure injection pump includes a pair of opposed reciprocating plungers 20, the movements of which are controlled by circumferentially spaced apart, inwardly directed, cam lobes 21 of a cam ring 22. Cam ring 22 is mounted for limited angular movement in the circular bore 23 of the pump housing 24.

As is well known, in this type pump, the rotor passage 16 sequentially registers with the passage 15, as the distributor rotor 17 rotates when the pump plungers 20 are free to move radially outward, whereby the pump chamber 18 can be supplied with a charge of fuel as determined by the control setting of the metering valve 14. Continued rotation of the distributor rotor 17 interrupts the communication between the rotor passage 16 and the passage 15 and, then, when the cam follower rollers 25 engage the rise of the cam lobes 21 they act through the rotor shoes 26 to force the pump plungers 20 inwardly so as to pressurize the fuel contained in the pump chamber 18 to a high injection pressure.

The thus pressurized fuel in the pump chamber 18 is then delivered by the rotor passage 16 to one of a series of passages, not shown, positioned in circumferentially spaced apart relationship to each other in the pump housing 24 around the distributor rotor 17 for sequential registry with the rotor passage 16, in a known manner, so as to effect the delivery of a charge of fuel from the pump chamber 18 sequentially to the cylinders of the associated engine. As is well known, the maximum outward radial movement of the shoes 26 may be limited, as desired, by engagement thereof with the ends of a leaf spring 27 adjustably mounted by a screw 28 to the distributor rotor 17.

In a known manner, the outlet of the transfer pump 10 is also connected by a passage 30 to the inlet of a fuel chamber 31, the outlet of which is connected by a passage 32 so as to supply fluid to the interior of the pump housing 24 whereby to provide for the lubrication of the various components of the pump mechanism mounted therein. The flow of fuel from the fuel chamber 31 out through the passage 32 is controlled by means of a conventional vent wire assembly 33 in a manner known in the pump art.

Fuel thus supplied to the interior of the pump housing 24 for the lubrication of the pump elements is then returned via a return line 34 to the fuel tank. As shown, the fuel return line 34 has a pressure regulator 35 incorporated therein whereby the fuel within the pump housing can be maintained at a predetermined low pressure relative to the pressure of fuel as supplied by the transfer pump. This pressure within the pump housing is hereinafter referred to as the housing pressure. Also, as shown, a spring biased pressure regulating valve 36 is provided to control the output from the transfer pump 10 to a predetermined maximum value. The output pressure of the transfer pump hereinafter referred to as transfer pressure, will vary with the speed of the engine with which the fuel pump is associated. For example, in a particular embodiment, the housing pressure will vary from 0 to 5 psi (0 to 34.474 kPa) maximum, while the transfer pressure will vary from 0 to 90 psi (0 to 620.528 kPa) for engine speeds of 0 to 3000 rpm.

To vary the timing of injection of the fuel into the associated cylinders of the engine, the cam ring 22 is rotated, as required, to adjust the angular position of the cam lobes 21 by means of a suitable advance timing control mechanism, generally designated 40, as a function of engine speed. Since the details of a particular embodiment of an advance mechanism with which the subject invention can be utilized is not deemed necessary for an understanding of the invention, only the control or advance piston 41 of such a mechanism need be described in detail herein insofar as it relates to its relationship with the subject invention.

However, it will become apparent to those skilled in the art that the advance timing control mechanism 40 may be of any suitable type having a suitable control or advance piston 41 therein, and thus could take any form, as shown for example in either of the aboveidentified U.S. Pat. Nos. 3,771,506 and 3,861,833 but, preferably it is of the type disclosed in the aboveidentified copending U.S. patent application, the disclosure of which is incorporated herein by reference thereto.

Such an advance piston 41 is operatively connected to the cam ring 22 by a cam pin, which in accordance with the invention would be an eccentric cam pin, generally designated 50, to be described in detail hereinafter. The advance piston 41 is thus operative to effect movement of the cam ring 22 either in a clockwise direction, with reference to FIG. 1, to effect an advance in timing or, in a counter-clockwise direction to retard timing.

Figure 2:
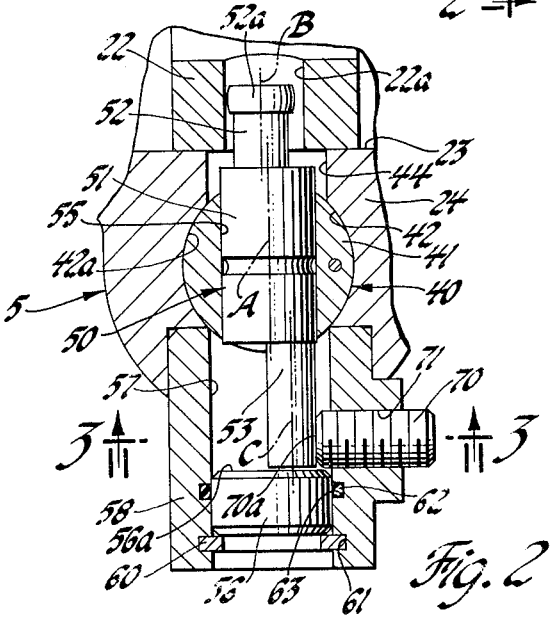
FIG. 2 is a side cross-sectional view of the pump timing advance mechanism with eccentric cam pin taken along line 2—2 of FIG. 1, and the eccentric cam pin still being shown in a full retard position for purpose of illustration only; and, FIG. 3 is a cross-sectional view of the eccentric cam pin and its adjuster screw, per se, taken along the line 3—3 of FIG. 2, the eccentric cam pin being positioned, for purpose of illustration, in a full retard position.

As shown in FIGS. 1 and 2, the advance piston 41 is slidably positioned in a circular internal bore wall 42*a* provided by a stepped bore 42 formed in the pump housing 24 at right angles to the axis of bore 23.

In a suitable manner, the motion of the advance piston 41 and therefore the position of the cam ring 22 is determined by metered transfer pump pressure, that is, transfer pressure supplied, as by a branch conduit 30*a*, whereby this pressure can be operative to act against one end of the advance piston 41 to effect movement thereof in an advance direction, to the left with reference to FIG. 1, which motion is opposed by a suitable resilient means, such as a spring means 43. The spring means 43 is operatively associated, in a suitable manner, with the opposite end of the advance piston 41 so as to normally bias it in a retard direction.

In addition, as is well known, during pump operation as the distributor rotor 17 rotates in a counter-clockwise direction with reference to FIG. 1, the rollers 25 will engage the cam ring 22 lobes 21 in a direction whereby a force is applied against the cam ring 22 tending to move it in a retard timing direction, that is, a counter-clockwise direction with reference to FIG. 1.

Now in accordance with a feature of the subject invention, the interconnection between the advance piston 41 and the cam ring 22 is by means of an eccentric cam pin 50 which is adapted to provide an adjustable offset between the cam ring 22 and the advance piston 41.

For this purpose, the eccentric cam pin 50, in the embodiment illustrated, includes an intermediate body portion 51 constituted as a body of revolution about an axis A, a cylindrical pin-like head 52 the axis B of which is offset a predetermined distance from the axis A of the body portion 51 and, a cylindrical pin-like foot 53, the axis C of which is offset a predetermined distance from the axis A of the body portion 51 and, in the embodiment illustrated is offset angularly 90° from the head 52. Both the head 52 and foot 53 of the eccentric cam pin 50 are of reduced diameters relative to the body portion 51 thereof.

As illustrated, the body portion 51 of the eccentric cam pin 50 is of a suitable external diameter whereby it is slidably and rotatably received in a cross bore 55 provided for this purpose in the advance piston 41.

The head 52 is of a suitable axial extent and is formed to include an upper enlarged diameter end portion **52*a* that is adapted to project up through a suitable elongated aperture 44 provided in the pump housing 24 into a suitable aperture 22*a* extending radially through the cam ring 22** whereby to effect movement of the cam ring.

As shown, the lower reduced diameter foot 53 of the eccentric cam pin is of a suitable axial extent so that the free end face thereof will be closely adjacent to the bearing end surface **56*a* of a closure means 56. In the embodiment illustrated, the closure means 56 is in the form of a plug that is received in the vertical intersecting bore 57 provided in tubular bottom housing extension 58 of the pump housing 24. As illustrated, this bore 57 is substantially aligned so that the axis thereof preferably intersects the axis of the circular bore 23 in the pump housing 24. In the embodiment illustrated, the closure means 56 is retained against movement in one axial direction within bore 57 by means of a split retaining ring 60 received within an annular groove 61 provided for this purpose in housing extension 58. In addition, an annular seal 62 positioned in an annular groove 63 is used to effect a fluid tight seal against the outer peripheral surface of the closure means 56**.

Also in accordance with the invention, an externally accessible adjusting means is used to effect and then maintain the angular position of the eccentric cam pin 50 whereby to maintain a required shift of the cam ring 22 position relative to the advance piston 41 so as to obtain the desired static timing of the pump to its associated engine.

In the embodiment illustrated, this externally accessible adjusting means is in the form of a socket head adjusting screw 70, that is of a suitable axial extent, and which is threadingly engaged in an internally threaded bore 71 provided in the housing extension 58. As shown, the internally threaded bore 71 is formed at right angles to the bore 57 in the housing extension 58 but it is offset a predetermined distance to one side of the axis of bore 57. In addition, this internally threaded bore 71 is positioned vertically so that its inboard end opens through the internal wall defining the bore 57 at a suitable location above the upper surface of the closure means 56 so that the adjusting screw 70 can extend into the bore 57 for engagement against the foot 53 of the eccentric cam pin 50.

Although in the embodiment shown, the adjusting screw 70 is provided with a socket head **70*b* whereby it is adapted to receive a suitable drive tool, not shown, to effect rotation of the screw as desired, it will be apparent that the adjusting screw can be provided with any other suitable wrenching head means such as, for example, a slot, not shown, to receive a screwdriver, also not shown. In addition, it will also be apparent that the mating threads of the adjusting screw 70 and of the bore 71 can be of any suitable pitch to obtain a desired lineal movement of the adjusting screw 70** per revolution thereof.

With this adjusting means arrangement, an operator, by the use of a suitable drive tool, can adjust the axial position of the adjusting screw 70, as necessary, whereby to obtain the necessary pivotal position of the eccentric cam pin 50 about its axis A so as to obtain the required position of the cam ring 22 to effect the required static timing of the pump 5 to the engine.

Figure 3:
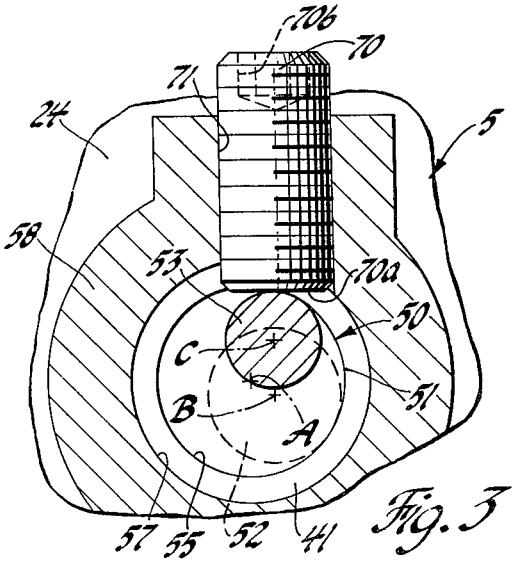

In the preferred embodiment illustrated and as best seen in FIG. 3, the diameter of at least that portion of foot 53 which engages the inboard end surface **70*a* of the adjusting screw 70 and the diameter of this adjusting screw are preselected for a particular advance timing mechanism 40 so that after timing of the pump, by adjustment of the angular position of the eccentric cam pin 50, the foot 53 will not ride off the end surface 70*a* of the adjusting screw 70 as the advance piston 41 is moved axially from a full retard position to a full advance position during normal engine operation of the pump 5**.

If the eccentric cam pin 50 is positioned as shown in FIG. 3, and the adjusting screw 70 is then torqued axially inward from the position shown, movement of this adjusting screw 70 will cause the foot 53 to move in a direction whereby to effect pivotal movement of the body portion 51 of the eccentric cam pin 50 about axis A. As this occurs, its integral head 52 will effect a shift of the cam ring 22 in an advance direction relative to the axis A and therefore relative to the advance piston 41 with respect to this axis A.

For example, in a particular pump 5 application, the foot 53 is adapted to travel through an arc of 120° with, of course, a corresponding movement of the head 52 in an arc about the axis A of the body portion 51 of the eccentric cam pin 50. This thus would permit an externally accessible mechanically adjustable shift of the cam ring 22 in an advance direction of approximately 8°. Thus if the eccentric cam pin 50 is assembled in a neutral position, that is, a position rotated 60° counter-clockwise from that shown in FIG. 3, the cam ring 22 can then be shifted by pivotal movement of this eccentric cam pin 50 so that the cam ring 22 can be adjusted approximately 4° in either an advance or retard timing direction relative to the advance piston 41.

It will be appreciated that in the embodiment disclosed, that if the eccentric cam pin 50 is installed in a neutral position, advancement of the adjusting screw 70 will cause pivotal movement of this cam pin 50 in a direction to cause the cam ring 22 to move in an advance timing direction. However, to effect movement of the cam ring 22 in a retard direction, the adjusting screw 70 is backed out and then the distributor rotor 17 is turned in a counter-clockwise direction, with reference to FIG. 1, so that the cam follower roller 25 riding up on the cam lobes 21 will force the cam ring 22 in a retard direction. As this occurs, this movement of the cam ring 22 engaging the head 52 will effect pivotal movement of the eccentric cam pin 50 until its foot 53 abuts against the end surface 70*a* of the adjusting screw 70.

However, since the subject invention provides an externally accessible means to correct timing, the original static timing of the injection pump can be corrected with the pump in operation. Thus the subject eccentric cam pin and its associated externally accessible adjusting screw permits a previously partly statically timed injection pump to have its static timing to an engine corrected through a dynamic timing process.

It will be apparent that the complete range of timing advance available by operation of the advance piston 41 is not decreased or limited by the use of an eccentric cam pin 50 in accordance with the invention in association therewith, since this eccentric cam pin is merely used to shift timing advance relative to the advance piston 41.

It will also be apparent that since the eccentric cam pin 50 permits a shift of the cam ring 22 position relative to the advance piston 41, it thus permits sufficient adjustment of the base static timing of the injection pump 5 to an engine without an operator having to rotate the entire injection pump with the mounting bolts loosened to permit such movement.

While the invention has been described with reference to a particular embodiment disclosed herein, it is not confined to the details set forth since it is apparent that various modifications can be made by those skilled in the art without departing from the scope of the invention. For example, instead of using a relatively large diameter adjusting screw, a smaller diameter adjusting screw could be used with a flat slide bar, not shown, operatively connected to the inboard end thereof for continuous abutment against the foot of the eccentric cam pin during advance piston motion to maintain the adjusted eccentric cam pin setting. This application is therefore intended to cover such modifications or changes as may come within the purposes of the invention as defined by the following claims.

The embodiments of the invention in which an exclusive property or privilege is claimed are defined as follows:

1. In a timing control mechanism for an engine driven fuel injection pump of the type having an annular cam movably positioned in a pump housing, pump plungers movable relative to the cam to translate the contour of the cam into sequential pump strokes, and an advance piston coupled to the annular cam by a cam pin engaged in a cross-bore in the advance piston that is used to adjust the angular position of the cam whereby to advance and retard the relative timing of the pump strokes; the improvement wherein said cam pin includes an intermediate body in the form of a body of revolution about an axis journaled in a cross-bore in the advance piston, a circular upper head located eccentric of said axis of said intermediate body and a circular lower abutment foot located eccentric of said axis of said intermediate body and offset 90° to said upper head; and, an externally accessible adjusting means operatively positioned in the pump housing in a location whereby to operatively abut against the lower abutment foot so as to adjustably effect angular movement of the cam pin and therefore of said upper head whereby to adjust the position of the cam for static timing of the pump relative to the engine.

2. In a timing control mechanism for an engine driven fuel injection pump of the type having an annular cam movably positioned in a pump housing, pump plungers movable relative to the cam to translate the contour of the cam into sequential pump strokes, and an advance piston coupled to the annular cam by a cam pin engaged in a cross-bore in the advance piston that is used to adjust the angular position of the cam whereby to automatically advance and retard the relative timing of the pump strokes during engine operation; the improvement wherein said cam pin includes an intermediate body in the form of a body of revolution about an axis journaled in the cross-bore of the advance piston, a circular pin-like head extending from one end of said intermediate body and located eccentric of said axis of said intermediate body and adapted to be operatively connected to the annular cam and, a circular pin-like foot extending from the opposite end of said intermediate body and located eccentric of said axis of said intermediate body and offset 90° to said head; and, an externally accessible adjusting screw threadingly engaged in the pump housing in a location whereby one end of said adjusting screw is externally accessible and the opposite end of said adjusting screw is positioned to abut against the said foot so as to adjustably effect angular movement of the cam pin and therefore of said head whereby to adjust the position of the cam for static timing of the pump relative to the engine.

3. In a timing control mechanism for an engine driven fuel injection pump of the type having a cam ring movably positioned in a pump housing, pump plungers movable relative to the cam ring to translate the contour of the cam ring into sequential pump strokes, and the timing control mechanism including an advance piston that is operatively coupled to the cam ring by a cam pin engaged in a cross-bore in the advance piston for adjusting the angular position of the cam whereby to advance and retard the relative timing of the pump strokes as a function of engine operation; the improvement wherein said cam pin is in the form of an eccentric cam pin that includes an intermediate body portion in the form of a body of revolution about an axis and of an external diameter to be pivotably journaled in the cross-bore of the advance piston, a circular pin-like head located eccentric of said axis of said intermediate body portion and a circular pin-like foot located eccentric of said axis of said intermediate body and offset 90° to said upper head, said head being operatively connected to the cam ring; and, an externally accessible adjusting means operatively positioned in the pump housing in a location whereby to operatively abut against the lower abutment head so as to adjustably effect angular movement of the cam pin and therefore of said head whereby to shift the position of the cam ring relative to the advance piston to adjust the static timing of the pump relative to the engine.

* * * * *